United States Patent [19]

Abdul-Rahman

[11] 4,068,759

[45] Jan. 17, 1978

[54] CONOIDAL SOLIDS SEPARATOR WITH SPECIAL SCRAPER AND SEPARATING METHOD

[75] Inventor: Yahia A. K. Abdul-Rahman, Plano, Tex.

[73] Assignee: Atlantic Richfield Company, Los Angeles, Calif.

[21] Appl. No.: 749,589

[22] Filed: Dec. 10, 1976

[51] Int. Cl.[2] ..... B07C 9/00

[52] U.S. Cl. ..... 209/112; 209/480

[58] Field of Search ..... 209/112, 74 R, 124, 209/479, 480, 471, 472, 459, 116, 117, 490, 493; 198/392, 540, 562, 636, 637

[56] References Cited

U.S. PATENT DOCUMENTS

| | | | |
|---|---|---|---|
| 1,291,278 | 1/1919 | Ulrich | 209/112 |
| 3,640,373 | 2/1972 | Seragnoli | 198/392 |

FOREIGN PATENT DOCUMENTS

| | | | |
|---|---|---|---|
| 498,085 | 5/1930 | Germany | 209/112 |

*Primary Examiner*—Tim R. Miles
*Assistant Examiner*—Ralph J. Hill
*Attorney, Agent, or Firm*—M. David Folzenlogen

[57] ABSTRACT

Spherically-shaped rolling solids are separated from irregularly-shaped nonrolling solids on the upper surface of a conoidally-shaped rotating table whereon most of the spherically-shaped solids roll from the surface of the table and most of the nonrolling solids move circumferentially with the table until they contact a special scraper which deflects the nonrolling solids off the bottom edge of the table. The action of the table, the scraper, and the two combined, causes nonrolling solids to move downwardly, outwardly and circumferentially in a first path, then in a circumferential path, and then downwardly, outwardly and circumferentially in a second path, and off the bottom edge of the table. This movement of the irregularly-shaped solids frees trapped rolling solids and allows them to roll downwardly and outwardly off the table while the nonrolling solids continue to move circumferentially. This continued circumferential movement prevents the nonrolling solids from interfering with the roll of the released spherically-shaped solids and prevents the nonrolling solids from being knocked or carried off the table by the freed rolling solids. This scraper action increases the separating efficiency of the system. Preferably, in the lower portion of the table, the degree of relative circumferential movement of the nonrolling solids is increased so that the rolling solids leave the table well ahead of the point where the nonrolling solids leave the table. This makes it easier to segregate collection of the solids.

10 Claims, 2 Drawing Figures

CONOIDAL SOLIDS SEPARATOR WITH SPECIAL SCRAPER AND SEPARATING METHOD

BACKGROUND OF THE INVENTION

This invention relates to a conoidal, rotating table solids separating system having a special spiral-like scraper. The separating system is for separating spherically-shaped rolling solids from irregularly-shaped nonrolling solids and is especially useful for oil shale retorting facilities using spherically-shaped heat carriers which are recovered and recycled through the retorting process.

There are many systems of separating solids which have significantly different particle sizes or particle weights, but there are relatively few dry, high capacity systems for efficiently separating solids having similar sizes and particle weights.

Copending Application Ser. No. 749,505, filed Dec. 10, 1976, which is entitled "Separation and Recovery of Heat Carriers in an Oil Shale Retorting Process", and which is owned by a common assignee and is incorporated herein, describes a conically-shaped rotating table separator for separating solids by differences in roll factor. The system is a dry, flexible, high capacity, efficient separating system. In this system, a mixture of spherically-shaped rolling solids and irregularly-shaped nonrolling solids is fed onto the table. The rolling solids roll off the table while the nonrolling solids come to rest on the table and move with the table until they are scraped off the table. These solids collect at the scraper and the operating characteristics of the table are partially affected by the design of the scraper. When the irregularly-shaped nonrolling solids come to rest on the table, they tend to trap rolling solids. The trapped rolling solids move with the irregularly-shaped solids and are either removed with these nonrolling solids or are removed at the same point as the nonrolling solids. In either case, the trapped rolling solids are disposed with the nonrolling solids unless other separating stages are used. This decreases the separating efficiency of the system.

This invention provides a special scraper arrangement for a conically-shaped table separator which causes release of trapped rolling solids and allows these solids to roll off the table at a point separate and apart from the point where the irregularly-shaped nonrolling solids are removed from the table.

SUMMARY OF THE INVENTION

A system for separating spherically-shaped rolling solids from irregularly-shaped nonrolling solids utilizes the upper surface of a rotating conoidally-shaped table. The surface of the table is appropriately inclined from horizontal by an angle equal to or greater than the static roll angle of the spherically-shaped solids and less than the static slide angle of the irregularly-shaped solids.

A mixture of the solids is fed at a feed point onto the rotating table by a supply means. Most of the spherically-shaped solids roll off the table to suitable receiving means. Most of the irregularly-shaped solids come to rest on the table and move with the table until they are removed to suitable removal means by a special scraper which is parallel to the surface of the table and is adapted to deflect solids in an advantageous path.

The special scraper coacts with rotation of the table to move the irregularly-shaped solids in a downward, outward, circumferential manner. This triple component displacement creates particle movements which free trapped rolling solids and allows them to roll off the table to suitable receiving means with less interference or interaction with irregularly-shaped solids still on the table. This triple component movement allows the irregularly-shaped solids to move circumferentially further away from the feed point than the points where the trapped rolling solids roll off the table, thereby increasing segregation of the solids and separation efficiency. In some embodiments of this invention, the relative degree of circumferential movement is increased near the lower part of the table to increase the spacing between the points where the trapped rolling solids roll from the table and the point where the nonrolling solids leave the table. In other embodiments, the scraper is sectionalized and adapted to deflect the solids in a triple component direction for a distance, then to allow the solids to move almost entirely in a circumferential direction until the solids contact another section of the scraper. This series of movements practically assures release and separate collection of all trapped rolling solids.

DETAILED DESCRIPTION

Figure 1:
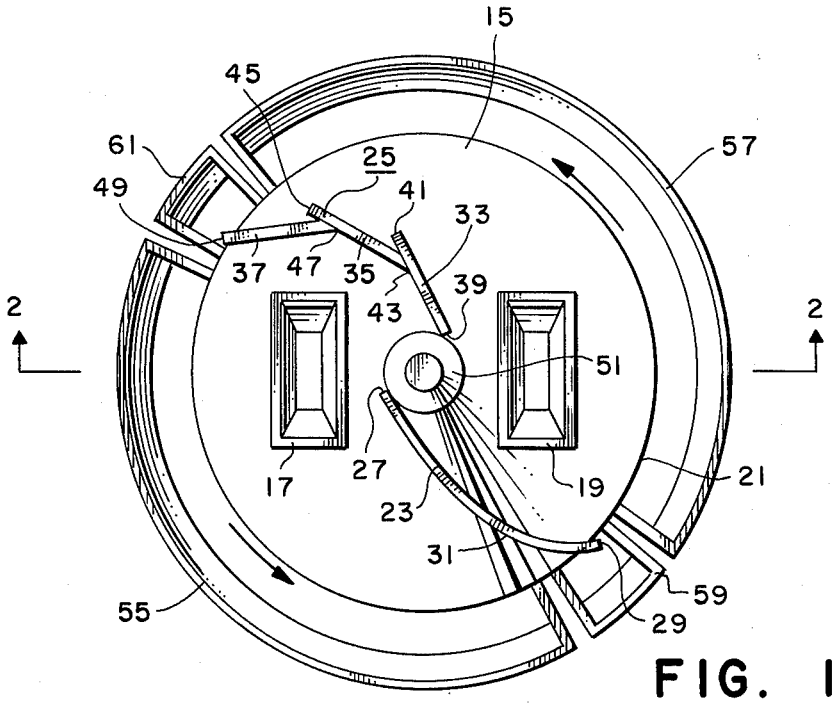
FIG. 1 is a top plan view of a conically-shaped table separator with special scrapers.
Figure 2:
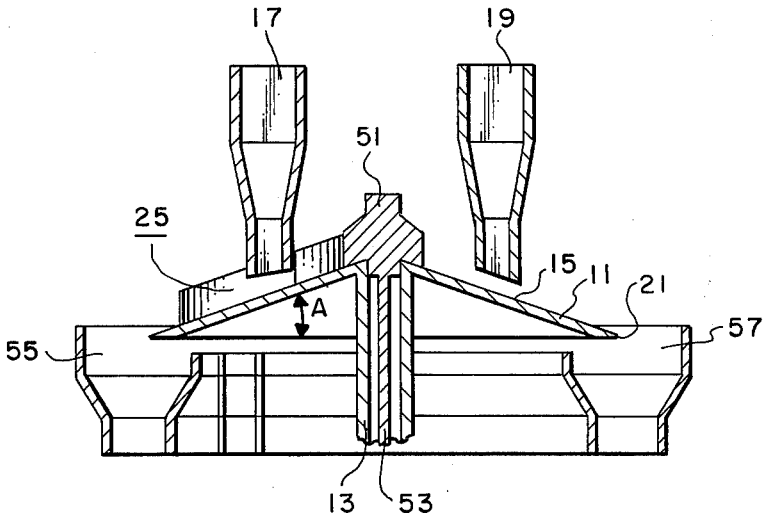
FIG. 2 is a sectionalized, side view of the separator of FIG. 1.

A conically-shaped rotating table separating system with special scraper is illustrated in FIGS. 1 and 2. As shown, conically-shaped member 11 with its apex pointing up is adapted to rotate about its vertical axis on vertically extending cylindrical shaft 13, which may be rotated by any suitable, controlled speed means. The conically-shaped member has inclined upper, outer surface 15. Above portions of the outer surface are supply means 17 and 19 which are any sort of system or systems, e.g., one or more chutes or passages, adapted to feed a mixture of spherically-shaped solids and irregularly-shaped solids onto an impingement area of a portion of outer surface 15.

Outer surface 15 is the basic medium used in the system for separating spherically-shaped solids which tend to roll down an inclined surface from irregularly-shaped solids which tend to slide down an inclined surface. In other words, the solids may be divided into two groups according to roll factor. The spherically-shaped solids are sufficiently round to roll down inclined outer surface 15 of the conically-shaped member. Generally, it is preferred that the rolling solids have a sphericity factor of at least 0.9. The sphericity factor is the external or geometric surface area of a sphere having the same volume as the spherically-shaped solid divided by the external surface area of the spherically-shaped solid. The nonrolling solids are sufficiently irregularly-shaped, laminar-like, flat, or rough, that one or more of their sides causes the irregularly-shaped solid not to roll down the inclined outer surface of the conically-shaped table. Instead, the irregularly-shaped solid will tend to come to rest on the outer surface. In processes using or producing a mixture of these two types of the solids, the spherically-shaped solids are usually in a narrower size range than the irregularly-shaped solids and in this size range, the concentration of spherically-shaped solids is greater than the concentration of irregularly-shaped solids.

Outer surface 15 of conically-shaped member 11 is inclined from horizontal at angle A which is at least as great as the static roll angle of the desired size spherically-shaped solids and is less than the static slide angle of the equal size irregularly-shaped solids. The static roll angle of the spherically-shaped solids is determined by holding an approximately median size, rolling solid at rest on the outer surface of the conically-shaped member at a point on the outer surface where a mixture of solids is to be fed onto or initially contact the outer surface and releasing such rolling solid to determine the minimum angle of the outer surface at which the released solid will roll down the outer surface. The static slide angle of the irregularly-shaped solids is determined by holding a nonrolling solid having a size approximately equal to the median size rolling solid at rest on a flat or rough side of the nonrolling solid against the outer surface and releasing the irregularly-shaped solid to determine the minimum angle for the outer surface at which such released solid will slide down the outer surface. The static roll angle of the spherically-shaped solids is less than the static slide angle of the irregularly-shaped solids. These angles inherently take into consideration the smoothness of the outer surface and the interaction between the surface of the solids and the surface of the table. Generally, it is desirable to test a representative number of such solids and a representative number of the different size solids of both types. The tests will be conducted with the table not rotating and will usually be conducted at normal room temperature, that is, 24° C (75° F). When the operating temperature is expected to significantly affect the rolling or sliding characteristics of the solids, it is best to determine these angles at the expected operating temperatures. For example, in an oil shale retorting process, the spherically-shaped solids may bear a combustible organic residue which affect the rolling characteristics of these solids at elevated temperatures.

The outer surface of the conically-shaped member thereby slopes downward with respect to the apex of the conoidal table, and outward or away from the vertical axis of the table until the outer surface of the member ends with lower edge rim 21 which is circular in shape. For descriptive purposes, cross-sectional planes of the outer surface of the conically-shaped member perpendicular to the vertical axis of the conically-shaped member may be considered as having circumferential or circular rim edges. In addition, the outer surface may be considered as having a lower surface area portion above and adjacent to the lower edge rim and a higher surface area portion above the lower surface area portion. These surface area portions and downward, outward, circumferential directions will be used to describe and explain certain features of the separating system.

As shown, the outer surface of the conically-shaped member is divided into two distinct separating sections by removal means 23 and removal means 25. Each removal means is adapted to coact with rotation of the conically-shaped member and movement of nonrolling solids resting on the outer surface to move the irregularly-shaped solids in a path which extends across the higher and lower surface area portions and terminates near lower edge rim 21. In other words, the removal means extends from above the impingement area of the mixture of solids to the lower edge rim. This path has at least the three component directions previously mentioned so that the irregularly-shaped solids are moved downwardly with respect to the apex of conically-shaped member 11, outwardly with respect to its vertical axis, and circumferentially with respect to supply means 17 or 19 and with respect to the cross-sectional planes perpendicular to the vertical axis of the conoidal table. This triple component movement coacts with rotation of the table to free trapped rolling solids and enable the two classes of solids to be collected at different points on lower edge rim 21.

As shown, removal means 23 is a quasi spiral-like scraper blade having upper end 27 which is at an elevation higher than supply means 17 and the solids impingement area of outer surface 15. The scraper blade has lower end 29 which is near lower edge rim 21 and a lower edge which is just above and parallel to the outer surface of the conoidal table. The lower edge of the scraper is close enough to the outer surface to scrape or deflect significant sized irregularly-shaped solids off the table. It is preferred that substantially all of the solids be removed except, perhaps, for very fine dust which passes under the scraper. The scraper has side 31 which extends upward from the lower edge of the blade and is adapted to deflect or move solids off the table. This side extends in a downward, outward, and circumferential direction with respect to the deflection of rotation of the impingement area of the outer surface away from supply means 17.

As shown, removal means 25 is a scraper blade of the type previously described except that the scraper blade is divided into first section 33, second section 35, and third section 37. First section 33 has upper end 39 and lower end 41. Second section 35 has upper end 43 and lower end 45. Third section 37 has upper end 47 and lower end 49. Upper end 39 of the first section is at an elevation higher than upper end 43 of the second section which is, in turn, at an elevation higher than upper end 47 of the third section. Lower end 41 of the first section is closer to supply means 19 and is at an elevation lower than upper end 43 of the second section. Lower end 45 of the second section is closer to supply means 19 and is at an elevation lower than upper end 47 of the third section. This scraper arrangement provides two points at lower end 41 and lower end 45 in the path of the irregularly-shaped solids, where the path has essentially only a circumferential component. Above and below these two points, the path of the solids has three component directions, that is, downward, outward, and circumferential. This enhances the release of spherically-shaped solids trapped by the irregularly-shaped solids.

The release of trapped rolling solids and the degree of separation of the removal points on lower edge rim 21 of the two types of solids may be further enhanced by changing the degree of circumferential movement per unit of outward component movement or outward extension of the scrapers in the lower surface area portion of outer surface 15. As shown, for each unit of outward component or extension, the ratio of the circumferential component or extension to the downward component of the path or extension of the scraper is greater in the lower surface area portion of outer surface 15 than this ratio is in the higher surface area portion of the outer surface. In the case of removal means 25, third section 37 has a greater ratio of circumferential extension to downward extension than second section 35 and the second section has a greater ratio than first section 33.

Removal means 23 and 25 are stationary and are mounted at their upper ends to hub 51 which in turn is mounted on stationary rod 53. This rod passes through the hollow cylindrical passage in vertically extending cylindrical shaft 13. This permits rotation of conically-shaped member 11 without movement of removal means 23 and 25.

In line with and below a portion of circular lower edge rim 21 are first receiving means 55 and 57 which are adapted to receive spherically-shaped solids rolling from outer surface 15 off the lower edge rim by the removal means. First receiving means 55 and 57 are any sort of system, e.g., one or more troughs, catchers, or chutes, for receiving the spherically-shaped solids. These receiving means are located and positioned below and circumferentially around the portions of conically-shaped member 11 where the ball-like solids roll from the surface.

In line with and below other portions of circular lower edge rim 21 are second receiving means 59 and 61 which are adapted to receive irregularly-shaped solids moved from outer surface 15 off the lower edge rim by the removal means. The second receiving means are any sort of system, e.g., one or more troughs, catchers, or chutes, for receiving the irregularly-shaped solids. This second receiving system is located and positioned below and circumferentially around the portions of conically-shaped member 11 where the irregularly-shaped solids leave the outer surface adjacent the lower ends of each removal means.

In operation, conically-shaped member 11 is rotated at an appropriate speed and a mixture of spherically-shaped solids and irregularly-shaped solids is fed at feed points onto an impingement area of outer surface 15. When the mixture hits the outer surface, most of the spherically-shaped solids are allowed to roll from the outer surface where they fall off lower edge rim 21 into the trough-like opening of first receiving means 55 and 57 and are collected by the receiving means. Most of the irregularly-shaped solids which are fed onto outer surface 15 come to rest and remain on the outer surface. Some of the spherically-shaped solids may be caught and held by the irregularly-shaped solids.

At the same time, as shown, conically-shaped member 11 is rotated in a constant counterclockwise direction and the spherically-shaped and irregularly-shaped solids remaining on the outer surface 15 move in generally circular or circumferential path away from the feed point around the vertical axis of the conically-shaped member and a clean, continuously restored impingement area is moved under the supply means. As the conically-shaped member is rotated, some of the trapped spherically-shaped solids may roll free from the irregularly-shaped solids and roll off the inclined conoidal surface into the first receiving means.

Continued rotation of the conically-shaped member causes the irregularly-shaped solids to move away from the feed point to a second point located away from the feed point where the solids on the table contact the removal means.

At the second point, the deflecting nature of the removal means and the moving force of the table and the sliding, nonrolling characteristics of the irregularly-shaped solids cause the irregularly-shaped solids on the outer surface to move in a downward direction away from hub 51, in an outward direction with respect to the vertical axis of the conically-shaped member, and in a circumferential direction with respect to the feed point and the circular path that the impingement area takes as the conically-shaped member is rotated. This removes the irregularly-shaped solids from the outer surface adjacent lower end 29 of removal means 23 or lower end 49 of removal means 25.

When the irregularly-shaped solids contact removal means 23, side 31 first moves the solids in a downward, outward and circumferential direction down to a lower surface area portion of outer surface 15. This movement causes the irregularly-shaped solids to change position relative to trapped spherically-shaped rolling solids. This will tend to free the trapped spherically-shaped solids which roll directly off the outer surface off lower edge rim 21. Then side 31 moves the solids in a second downward, outward, circumferential direction. The rate of circumferential movement per unit of outward direction of the second direction is greater than the rate of circumferential movement of the first direction. This causes the irregularly-shaped solids to shift more horizontally relative to any trapped spherically-shaped solids. This tends to cause the trapped rolling solids to be released. Since the irregularly-shaped solids are moved horizontal relative to the freed rolling solids and are moving more circumferentially, the irregularly-shaped solids do not interfere with release and downward, outward roll of the freed rolling solids. Moreover, since the irregularly-shaped solids are moving more circumferentially in the lower portion of the outer surface, the point of removal of the irregularly-shaped solids is segregated from the last point of release of trapped rolling solids.

When the solids contact removal means 25, the solids undergo a similar movement to that just described except that solids contacting first section 33 move down below end 41 or contacting second section 35 move below lower end 45 where they move substantially in only a circumferential direction until they contact the next lower section of removal means 25. This further assures release of trapped rolling solids.

The volumes and relative amounts and sizes of the solids in the mixture will affect the overall design of the separating system. The spherically-shaped solids are normally in a relatively narrow size range when compared to the irregularly-shaped solids. The conoidally-shaped rotating table system is especially suited to spherically-shaped solids in having a size above 0.14 centimeter (0.055 inch). The separating system performs best when a significant portion or all of the larger size and smaller size irregularly-shaped solids, especially fine size solids, are removed prior to using the rotating table separating system. Fortunately, it is usually relatively easy to separate and remove a significant portion of the irregularly-shaped or fine size undesired solids.

If there is an appreciable amount of irregularly-shaped solids which are larger than the spherically-shaped solids and the volumes to be handled justify it, it would be best to first process the mixture to separate at least a portion of the larger irregularly-shaped solids prior to using the conoidal rotating table system. The larger size irregularly-shaped solids may be separated by screening. This initial screening or separation of the larger size solids is optional and this step may be delayed until after some of the smaller size irregularly-shaped solids are removed.

By the same token, if the amount of irregularly-shaped solids smaller than the spherically-shaped solids is sufficiently large to warrant it, it would be best to remove at least a portion of the finer irregularly-shaped solids prior to treating the mixture on the inclined outer surface of the table. Fine size solids greatly affect rolling characteristics and tend to unduly adhere to the separating surface of the table. A significant portion, especially fines, of the smaller size irregularly-shaped solids may be removed by screening or by a low velocity elutriating gas. If the system is to be operated at elevated temperatures, it will be desirable to heat the gas used in elutriation. The gas should be a noncombustion supporting gas if there are combustible materials present on the solids.

The separating system of this invention is particularly advantageous for separating spherically-shaped heat carriers from irregularly-shaped spent shale, especially porous pellet heat carriers in a size range of between 0.14 centimeters (0.055 inch) to approximately 1.27 centimeter (0.5 inch) of the type described in U.S. Pat. No. 3,844,929. In oil shale retorting, mined crushed oil shale is mixed with hot, heat-carrying spherically-shaped solids in a retort. The heat in the hot heat carriers pyrolyzes oil and gas vapors from the oil shale and produces a mixture of spherically-shaped solids and nonrolling spent shale. After retorting, the solids mixture is processed to recover the heat carriers for recycle through the retorting process and for separation and disposal of the spent shale. This separation and recovery of solids is usually accomplished in several stages. One of the separating stages will use the conoidally-shaped rotating table system of this invention. As mentioned in Copending Application Ser. No. 749,505, the efficiency of this process will be increased if a portion of the irregularly-shaped spent shale solids larger than the heat carriers is removed and if a portion of the irregularly-shaped spent shale solids smaller than the heat carriers is removed prior to processing a mixture of the remaining solids on the inclined outer surface of the rotating table system of this invention.

The foregoing description and explanations provide a dry, high capacity, flexible, efficient system for separating rolling solids from nonrolling solids which uses a conically-shaped table with scraper means that facilitate the separation efficiency of the system. It is understood that variations and modifications may be made thereon, and it is intended to cover in the appended claims all such variations and modifications as fall within the spirit and scope of the invention.

The embodiments of the invention in which an exclusive property or privilege is claimed are defined as follows:

1. A system for separating spherically-shaped solids which tend to roll down an inclined surface from irregularly-shaped solids which tend to slide down an inclined surface comprising:

a. a conically-shaped member with its apex pointing up, said conically-shaped member being adapted to rotate about its vertical axis and having an outer surface inclined from horizontal at an angle at least as great as the static roll angle of the spherically-shaped solids and less than the static slide angle of the irregularly-shaped solids, said outer surface having a lower edge rim, a lower surface area portion above and adjacent said lower edge rim, and a higher surface area portion above said lower surface area portion;

b. supply means adapted to feed a mixture of said spherically-shaped solids and said irregularly-shaped solids onto an impingement area in said higher surface area portion of said outer surface;

c. a sectionalized removal means having at least a first and a second section, said sectionalized removal means adapted to coact with rotation of said conically-shaped member and movement of irregularly-shaped solids with said conically-shaped member to move said irregularly-shaped solids in a path extending across said higher and said lower surface area portions and terminating near said lower edge rim, said path having at least three component directions, said component directions being downwardly with respect to the apex of said conically-shaped member, outwardly with respect to the vertical axis of said conically-shaped member, and circumferentially with respect to said supply means and to the perimeter of cross-sectional planes perpendicular to the vertical axis of said conically-shaped member, said path having essentially only a circumferential component direction at at least one point, said at least one point being between two parts of said path having said three component directions, and the remaining portions of said path having at least said three component directions;

d. means adapted to receive spherically-shaped solids rolling from said outer surface off said lower edge rim, and e. means adapted to receive irregularly-shaped solids moved from said outer surface off said lower edge rim by said removal means.

2. The system of claim 1 wherein for each unit of outward component, the ratio of the circumferential component to the downward component of the path in the lower surface area portion of the outer surface is greater than the ratio of said circumferential component to said downward component in the higher surface area portion of said outer surface.

3. The system of claim 1 wherein the sectionalized removal means is a sectionalized scraper blade having an upper end at an elevation higher than the impingement area of the outer surface and a lower end near the lower edge rim of said conically-shaped member, each of said sections of said sectionalized scraper blade having a lower edge just above and generally parallel to said outer surface of said conically-shaped member and a side extending upward from said lower edge, said side being adapted to deflect irregularly-shaped solids moving with said outer surface, said side extending in a downward, outward and circumferential direction with said upper end being closer with respect to the direction of rotation of said upper surface to the supply means than said lower end.

4. The system of claim 3 wherein for each unit of outward extension of the sectionalized scraper blade, the ratio of the amount of circumferential extension to the amount of downward extension in the lower surface area portion of said outer surface is greater than the ratio of the amount of circumferential extension to the amount of downward extension in the higher surface area portion of said outer surface.

5. The system of claim 4 wherein said sectionalized scraper blade has at least a first, a second and a third section, each of said sections having different ratios of circumferential extension to downward extension, the ratio of said first section being less than the ratio of said second section, and the ratio of said second section being less than the ratio of said third section.

6. The system of claim 5 wherein each of said first, said second and said third sections of said sectionalized scraper blade have a lower end and an upper end, said upper end of said first section being at a higher elevation than said upper end of said second section, said lower end of said first section being at a lower elevation than said upper end of said first section and being closer with respect to the direction of rotation of said upper surface to said supply means than said upper end of said second section, said upper end of said second section being at a higher elevation than said upper end of said third section, said lower end of said second section being at a lower elevation than said upper end of said third section and being closer with respect to the direction of rotation of said upper surface to said supply means than said upper end of said third section; and wherein there is a first and a second point of said path having essentially only a circumferential component direction, said first point being at said lower end of said first section, and said second point being at said lower end of said second section.

7. The system of claim 4 wherein the first and the second sections have different ratios of circumferential extension to downward extension.

8. The system of claim 7 wherein each of said first and said second sections of said sectionalized scraper blade have a lower end and an upper end, said upper end of said first section being at a higher elevation than said upper end of said second section, said lower end of said first section being at a lower elevation than said upper end of said second section and being closer with respect to the direction of rotation of said upper surface to said supply means than said upper end of said second section, the ratio of the circumferential extension to the downward extension of said first section being less than the ratio of the circumferential extension to the downward extension of said second section, and said point of said path having essentially only a circumferential component direction being at said lower end of said first section.

9. A method for separating spherically-shaped solids which tend to roll down an inclined surface from irregularly-shaped solids which tend to slide down an inclined surface comprising:

a. feeding a mixture of spherically-shaped solids and irregularly-shaped solids at a feed point onto an impingement area of the outer surface of a conically-shaped member having its apex pointing up, said outer surface being inclined from horizontal at an angle which is at least as great as the static roll angle of said spherically-shaped solids and which is less than the static slide angle of said irregularly-shaped solids:

b. allowing most of said spherically-shaped solids fed onto said outer surface to roll downward off said outer surface;

c. collecting the spherically-shaped solids which have rolled from said outer surface;

d. moving a portion of said outer surface with irregularly-shaped solids thereon during the time that step (a) is taking place in a direction such that irregularly-shaped solids on said outer surface move to a second point located away from said feed point and in a direction such that said impingement area of said outer surface is constantly changing and said portion moves from said feed point in a circular path around a vertical axis of said conically-shaped member;

e. at said second point, moving irregularly-shaped solids on said outer surface in a downward, outward and circumferential direction to a third point, said outward direction being with respect to the vertical axis of said conically-shaped member, and said circumferential direction being with respect to said feed point and the circular path of said impingement area;

f. at said third point, moving irregularly-shaped solids on said outer surface in substantially only a circumferential direction to a fourth point;

g. at said fourth point, moving irregularly-shaped solids in a downward, outward and circumferential second direction, the rate of circumferential movement per unit of outward direction being greater in said second direction than in said first direction; and h. removing irregularly-shaped solids from said outer surface.

10. The method according to claim 9 wherein in step (g), the irregularly-shaped solids are moved to a fifth point, and before step (h), the method includes the following steps:

i. at said fifth point, moving irregularly-shaped solids on said outer surface are moved in substantially only a circumferential direction to a sixth point; and j. at said sixth point, moving irregularly-shaped solids in a downward, outward and circumferential third direction, the rate of circumferential movement per unit of direction being greater in said third direction than in said second direction.

* * * * *